US005571231A

United States Patent [19]

Lee

[11] Patent Number: 5,571,231

[45] Date of Patent: Nov. 5, 1996

[54] APPARATUS FOR STORING A MULTI-COMPONENT CRYOGENIC LIQUID

[75] Inventor: Ron C. Lee, Bloomsbury, N.J.

[73] Assignee: The BOC Group, Inc., New Providence, N.J.

[21] Appl. No.: 547,764

[22] Filed: Oct. 25, 1995

[51] Int. Cl.[6] ..... F17C 7/04

[52] U.S. Cl. ..... 62/48.2; 62/50.4

[58] Field of Search ..... 62/48.2, 50.4

[56] References Cited

U.S. PATENT DOCUMENTS

| | | | |
|---|---|---|---|
| 2,944,405 | 7/1960 | Basore et al. | 62/48.2 |
| 3,266,262 | 8/1966 | Moragne | 62/48.2 |
| 3,303,660 | 2/1967 | Berg | 62/48.2 |
| 3,714,790 | 2/1973 | Battey | 62/48.2 |
| 4,276,749 | 7/1981 | Crowley | 62/48.2 |
| 4,727,723 | 3/1988 | Durr | 62/48.2 |
| 5,076,822 | 12/1991 | Hewitt | 62/48.2 |

FOREIGN PATENT DOCUMENTS 0091996 6/1983 Japan .

*Primary Examiner*—Ronald C. Capossela
*Attorney, Agent, or Firm*—David M. Rosenblum; Larry R. Cassett

[57] ABSTRACT

An apparatus for storing a multi-component cryogenic liquid in which headspace vapor in a storage tank is condensed in an external condensation tank through indirect heat exchange with liquid being vented from the storage tank. The resulting condensate can then be re-introduced into the storage tank through a pressure building circuit applied to the external condensation tank. In such manner, the pressure within the storage tank is regulated and the composition of the liquid stored within the storage tank is held with some degree of consistency. The use of an external condensation tank allows prior art cryogenic storage tanks and dewars to be retrofitted to store a multi-component cryogenic liquids.

7 Claims, 1 Drawing Sheet

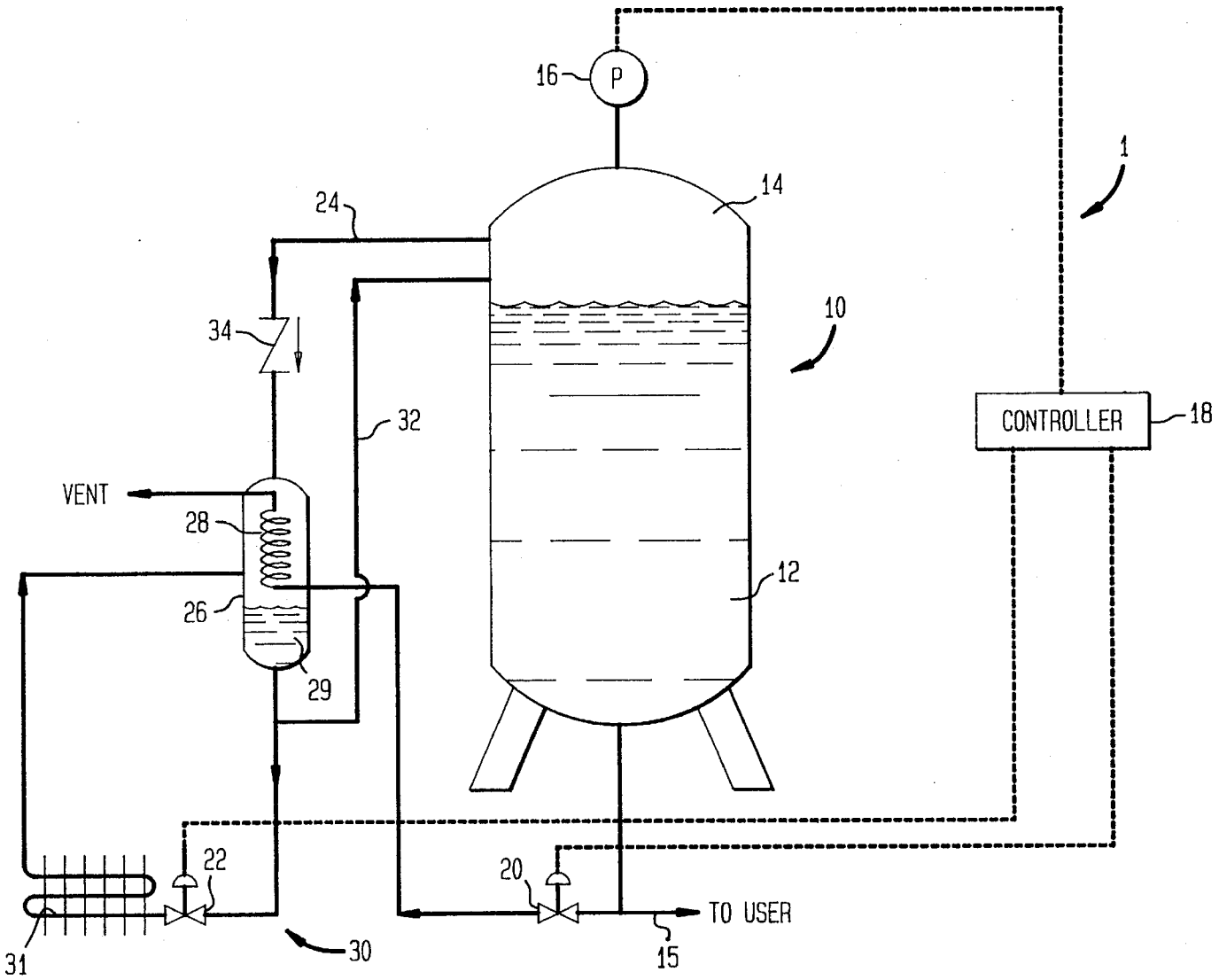
1
CONTROLLER
18
10
14
12
P
16
TO USER
15
20
32
24
29
30
34
28
26
22
VENT
31

APPARATUS FOR STORING A MULTI-COMPONENT CRYOGENIC LIQUID

BACKGROUND OF THE INVENTION

The present invention relates to an apparatus for storing a multi-component cryogenic liquid within a storage tank. More particularly, the present invention relates to such an apparatus in which headspace vapor within the storage tank is condensed by indirect heat transfer with the cryogenic liquid. More particularly, the present invention relates to such an apparatus in which the headspace vapor is condensed within an external condensation tank and the resulting condensate is remmed to the storage vessel by a pressure building circuit.

Cryogenic storage vessels and dewars are used to store cryogenic liquids, for instance, liquefied atmospheric gases, either at their point of use or for use in the transport of such cryogenic liquids. Although such storage tanks and dewars are insulated, there is still heat leakage into the storage tank or dewar. This heat leakage causes vaporization of the liquid cryogen. Typically, the vapor is vented from a headspace region of the tank to prevent overpressurization of the tank. Where the liquid cryogen is a multi-component mixture, for instance air, the venting of the vapor phase presents a problem because the more volatile components will vaporize before the less volatile components. As a result, the liquid being stored will have an ever increasing concentration of the less volatile components. For instance, if the liquid cryogen being stored is liquid air, nitrogen (as well as other components of the air but at a lower concentration) will be vented to cause the liquid to have an ever increasing oxygen content.

In order to overcome this problem, U.S. Pat. No. 3,260,060 discloses a cryogenic dewar in which liquid is vented through a heat exchanger located within the headspace region of the dewar. As pressure within the dewar increases, the liquid passing through the heat exchanger condenses the vapor to stabilize the concentration of the liquid. Since the liquid, now vaporized, is at the same concentration of the bulk liquid, there is no concentration change.

The problem with the cryogenic dewar illustrated in U.S. Pat. No. 3,260,060 is that it involves manufacturing dewars with heat exchangers in the headspace region and thus, cannot easily serve as a retrofit to existing cryogenic dewars. As will be discussed, the present invention solves the retrofitting problem by providing a cryogenic storage apparatus that is easily adapted as a retrofit for conventional cryogenic storage tanks and dewars.

SUMMARY OF THE INVENTION

The present invention provides an apparatus for storing a multi-component cryogenic liquid in which the multi-component cryogenic liquid is stored within a storage tank. A condensation tank is located externally to the storage tank for condensing headspace vapor. A heat exchange means is located within the condensation tank for condensing the headspace vapor. The heat exchange means is in communication with the storage tank and vents to the atmosphere so that a liquid stream from the storage tank vaporizes within the heat exchange means against the condensation of the headspace vapor and then vents to the atmosphere. An actuable valve means is provided for permitting the liquid stream to flow to the heat exchange means when the pressure within the headspace region is above a pre-determined value. The condensation tank is connected to the storage tank to permit the headspace vapor to flow from the headspace region of the storage tank to the condensation tank and the condensed headspace vapor to flow back into the storage tank. A means is provided for driving the condensed headspace vapor back into the storage tank after the pressure falls below the pre-determined value.

Since the condensation occurs within an external condensation tank, such external condensation tank can be retrofitted with appropriate plumbing to existing storage tanks and dewars.

BRIEF DESCRIPTION OF THE DRAWINGS

While the specification concludes with claims distinctly pointing out the subject matter that Applicant regards as his invention, it is believed the invention will be better understood when taken in connection with the accompanying drawing in which the sole FIGURE is a schematic view of a storage apparatus in accordance with the present invention.

DETAILED DESCRIPTION

With reference to the FIGURE, an apparatus 1 in accordance with the present invention is provided for storing a multi-component cryogenic liquid, for instance, liquid air. Apparatus 1 utilizes a conventional storage tank 10 containing a multi-component liquid cryogen 12. Storage tank 10, as would be known to those skilled in the art, would be conventionally insulated. Due to heat leakage into storage tank 10, liquid cryogen 12 vaporizes to form vapor within a headspace region 14 thereof. Liquid cryogen 12 flows to a user through conduit 15.

A pressure sensor 16 is provided within storage tank 10 to sense pressure within headspace region 14. Pressure sensor 16 is linked to a controller 18 which is responsive to a pressure signal generated by pressure sensor 16 to control remotely operated valves 20 and 22. When pressure within headspace region 14 reaches a pre-determined value, the signal generated by pressure sensor 16 causes controller 18 to set control valve 20 into an open position. Headspace vapor within headspace region 14 flows within outlet conduit 24 to condensation tank 26. The opening of control valve 20 allows liquid to flow from the bottom of storage tank 10 into a conduit 28 which by indirect heat exchange causes headspace vapor within condensation tank 26 to condense into a liquid shown in the drawings as condensed headspace vapor 29.

When the pressure falls below the pre-determined value, control valve 22 opens and control valve 22 closes. The opening of control valve 22 causes the subsidiary stream of the condensed headspace vapor 29 to flow within a pressure building circuit 30 (having an ambient vaporizer 31) and pressurize condensation tank 26. This pressure drives the condensed headspace vapor 29 from condensation tank 26 through return line 32 back into storage tank 14. It is to be noted that although condensed headspace vapor 29 is illustrated as flowing back in to headspace region 14, it could by appropriate piping flow back into multi-component liquid cryogen 12. As pressure approaches a pre-determined value controller 18 commands control valve 22 to close. A check valve 34 within outlet conduit 24 prevents backflow of vapor through inlet conduit 24.

As could be appreciated by those skilled in the art, check valve 34 could be replaced with a solenoid or other type of control valve. Although a pressure building circuit 30 is illustrated, alternates could be used such as electrical heating replacing ambient vaporizer 31.

In addition to the foregoing, numerous control strategies could be employed to optimize the venting process and maintain pressure. For example, the level of the condensate or the temperature of the vent gas could be monitored to determine that the condensate level had risen too far. Appropriate control logic could then cause a switch to the pressure building circuit to pump the liquid back into the storage vessel, prior to further venting. Alternatively, a timer could be employed where pressure building/pumping could be initiated after a fixed time, then switching back to further venting for a fixed time, and etc.

While the invention has been discussed with reference to a preferred embodiment, as will occur to those skilled in the art, numerous changes, omissions and additions may be made without departing from the spirit and scope of the present invention.

I claim:

1. An apparatus for storing a multi-component cryogenic liquid comprising:

a storage tank to contain said multi-component cryogenic liquid;

a condensation tank located external to said storage tank for condensing headspace vapor;

heat exchange means located within said condensation tank for condensing said head space vapor, said heat exchange means in communication with said storage tank and vented to atmosphere so that a liquid stream from said storage tank vaporizes within said heat exchange means against said condensation of said head space vapor and vents to said atmosphere;

actuable valve means for permitting said liquid stream to flow to said heat exchange means when pressure within said headspace region is above a predetermined value;

said condensation tank connected to said storage tank to permit said headspace vapor to flow from a headspace region of said storage tank to said condensation tank and said condensed headspace vapor to flow back into said storage tank; and means for driving said condensed headspace vapor back into said storage tank after said pressure falls below said predetermined value.

2. The apparatus of claim 1, wherein said condensed headspace vapor is driven back into said headspace region of said storage tank.

3. The apparatus of claim 1, wherein said condensed headspace vapor driving means comprises actuable pressure building means for building pressure within said condensation tank to drive said condensed headspace vapor back into said storage tank after said pressure falls below said predetermined value.

4. The apparatus of claim 1, wherein:

said condensation tank is connected to said storage tank by outlet and return conduits;

said outlet conduit communicating between a top region of said condensation tank and said headspace region of said storage tank;

said return conduit communicating between a bottom region of said condensation tank and headspace region of said storage tank; and said outlet conduit has a check valve to prevent backflow of said headspace vapor into said storage tank.

5. The apparatus of claim 2, wherein said actuable pressure building means comprises a pressure building circuit to vaporize a portion of the condensed headspace vapor and thereby pressurize said condensation tank.

6. The apparatus of claim 2, wherein:

said actuable pressure building means comprises a pressure building circuit to vaporize a portion of the condensed headspace vapor and thereby pressurize said condensation tank and a fat remotely activated valve to permit said portion of said headspace vapor to flow from said condensation tank thereto;

said valve means comprises a second remotely activated valve;

a pressure sensor is located in said headspace region of said storage tank to generate a pressure signal referable to said pressure;

a controller, responsive to said pressure signal, controls said first and second remotely activated valves so that when said pressure is above said predetermined pressure said second remotely activate valve opera and when said pressure falls below said predetermined pressure said second remotely activate valve closes and said first remotely activated valve opens.

7. The apparatus of claim 6, wherein:

said condensation tank is connected to said storage tank by outlet and return conduits;

said outlet conduit communicating between a top region of said condensation tank and said headspace region of said storage tank;

said return conduit communicating between a bottom region of said condensation tank and headspace region of said storage tank; and said outlet conduit has a check valve to prevent backflow of said headspace vapor into said storage tank.

* * * * *